United States Patent [19]

Lala et al.

[11] 4,304,180

[45] Dec. 8, 1981

[54] BOTTLE PRINTER

[75] Inventors: Louis A. Lala, Skokie; Efim Motev, Chicago, both of Ill.

[73] Assignee: American Screen Printing Equipment Company, Chicago, Ill.

[21] Appl. No.: 74,657

[22] Filed: Sep. 12, 1979

[51] Int. Cl.[3] ..... B41F 17/22

[52] U.S. Cl. ..... 101/40; 101/123; 101/126

[58] Field of Search ..... 101/126, 123, 38 R, 101/38 A, 39, 40, 35

[56] References Cited

U.S. PATENT DOCUMENTS

| | | | |
|---|---|---|---|
| 2,882,818 | 4/1959 | Vowles | 101/126 |
| 3,139,824 | 7/1964 | Derrickson | 101/126 X |
| 3,249,044 | 5/1966 | Karlyn | 101/38 R |
| 3,533,353 | 10/1970 | Dubuit | 101/40 |
| 3,538,845 | 11/1970 | Peck et al. | 101/126 X |
| 3,874,289 | 4/1975 | Valentin | 101/39 X |
| 3,897,725 | 8/1975 | Derrickson | 101/126 X |
| 4,051,775 | 10/1977 | Watson | 101/38 A |
| 4,111,118 | 9/1978 | Green et al. | 101/123 |

FOREIGN PATENT DOCUMENTS

| | | | |
|---|---|---|---|
| 2453064 | 5/1975 | Fed. Rep. of Germany | 101/126 |
| 2714652 | 10/1977 | Fed. Rep. of Germany | 101/126 |

*Primary Examiner*—Clifford D. Crowder

*Attorney, Agent, or Firm*—Robert E. Wagner; Ralph R. Rath

[57] ABSTRACT

A bottle printer includes a carriage reciprocated along a fixed screen and a squeegee and flood bar carried by the carriage. A bottle support and a nose cone are adjustably supported on the carriage to accommodate bottles of different sizes. A bottle registration mechanism is supported on the carriage and moves with the carriage.

8 Claims, 10 Drawing Figures

BOTTLE PRINTER

BACKGROUND OF THE INVENTION

The subject invention relates generally to the field of screen printing and, more specifically, to an apparatus for printing cylindrical objects by means of a squeegee and bottle support which are mounted on a single carriage on either side of a fixed printing screen for unitary movement therealong to print such objects in a compact stroke.

Many existing screen printing presses for the printing of conical or cylindrical-shaped objects, include a fixed squeegee under which a printing screen moves in unison with the rotation of the object to be printed. More advanced cylindrical or conical screen printers having fixed squeegees may include adjustable drive means to vary the speed of the movable screen to correspond with the rotational movement of objects having different diameters, for uniform application of print.

It has been found that a problem of obtaining uniform registration of the screen and cylindrical object to be printed, such as a bottle, may occur in such machines having a movable screen with adjustable drive means. Not only must the bottle be registered in the same position relative to the screen at the beginning of each print stroke, but the rate of movement of the screen relative to the bottle rotation must be identical for each bottle to assure uniform print location and clarity. As is apparent, such machines require an adjustment of the timing of the drive mechanism for each different diameter bottle printed, and additional adjustments may be necessary. Such adjustments lengthen set-up time of the press from job to job, and if done improperly, could result in non-uniform registration of the printed material on the object.

SUMMARY OF THE INVENTION

The bottle printer herein eliminates the need for time-consuming and potentially inaccurate adjustments of the screen or bottle drive mechanism, by providing a single carriage on which both the squeegee and the bottle support are mounted for unitary movement with the bottle support disposed beneath the screen. Regardless of the bottle diameter, the speed of the squeegee automatically corresponds with the bottle rotation as it moves beneath the screen. Moreover, accurate alignment of the squeegee and bottle at the beginning of each print stroke is assured since both are supported on the same carriage. In addition, the provision of a movable squeegee and bottle, as compared to machines having movable screens, reduces by one-half the press bed length necessary to print bottles of the same diameter.

It is an object of the present invention to provide a screen printing press in which the squeegee and cylindrical object to be printed are mounted on a single carriage for unitary movement above and below a fixed printing screen, respectively.

It is a further object of the present invention to provide a registration means associated with the carriage for placement of each bottle to be printed in alignment with the squeegee at the beginning of each print stroke for uniform registration of print.

It is another object of the present invention to provide a printing press having transfer means operable to place a cylindrical object to be printed in a position for registration at the beginning of the print stroke, and then to deposit such object on conveyor means for transfer to an appropriate ink dryer.

DESCRIPTION OF THE DRAWINGS

Objects in addition to the foregoing will become apparent upon consideration of the following description taken in conjunction with the accompanying drawings wherein.

DETAILED DESCRIPTION OF THE INVENTION

Figure 1:
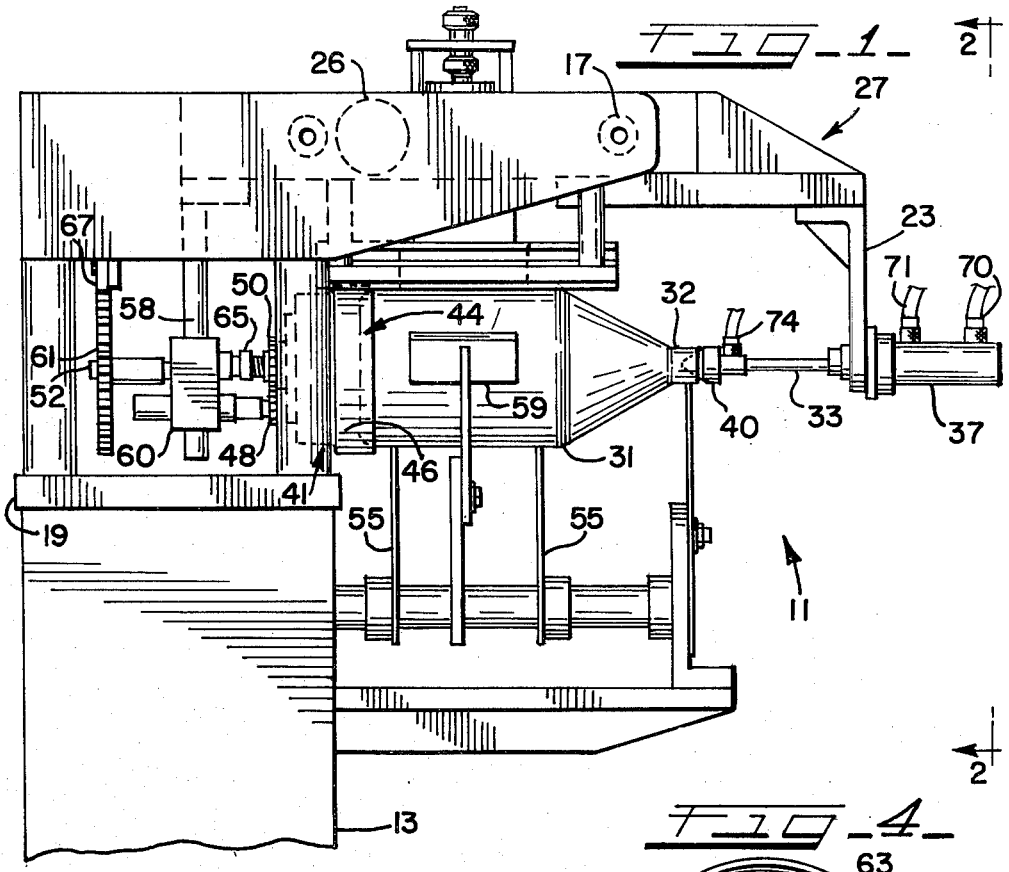
FIG. 1 is a partial front perspective view of one embodiment of the present invention showing the carriage support of the bottle and squeegee.

Referring now to the drawings, and in particular the embodiment of the present invention shown in FIG. 1, the bottle printer herein is labeled generally with the reference 11. Printer 11 includes a frame 13 having a pair of carriage guide bars 15 and 17 mounted in spaced relation upwardly from a base plate 19 of frame 13, to a pair of end plates 20 and 22. Adjustably mounted to the guide bars 15 and 17 is a screen support labeled generally as 21, having mounting brackets 16 and 24 for supporting a screen frame 18 to which a printing screen 25 is attached. The position of screen support 21 may be varied by moving mounting brackets 16 and 24 along guide bars 15 and 17 to accommodate printing screens 25 of varying length for printing of objects having different diameters, as discussed below. Once the mounting brackets 16 and 24 of support 21 are positioned on guide bars 15 and 17, the printing screen 25 is held in a fixed position relative to frame 13 throughout the press operation.

A carriage 27 is movably mounted to guide bars 15 and 17 and is reciprocated therealong by a pneumatic or hydraulic drive cylinder 26 which attaches to carriage 27 and is mounted at one end to end plate 20 and at the other end to end plate 22. Drive cylinder 26 is actuated by limit switches 38 and 42, adjustably mounted adjacent the mounting brackets 16 and 24, respectively. As carriage 27 moves along guide bars 15 and 17 toward mounting bracket 16 during the print stroke, it engages limit switch 38 which mechanically reverses the movement of carriage 27 to the opposite end of screen 25 for the flood stroke. At the end of such reverse movement, limit switch 42 is engaged to reciprocate carriage 27 back to the opposite end of screen 25 to accomplish the print stroke.

Mounted to carriage 27 in a position immediately above screen 25 is a printing assembly including a squeegee 29 and flood bar 30 of known construction, which alternately pivot into contact with screen 25. As is well known, during the print stroke squeegee 29 contacts screen 25 to force ink therethrough to the work to be printed, which in the subject invention is a bottle or other cylindrical object, as discussed below. At the end of the print stroke when carriage 27 contacts limit switch 38 to reverse the direction of travel, the flood bar 30 is pivoted downwardly by a pneumatic cylinder 36, as squeegee 29 pivots upwardly, to contact screen 25 for the flood stroke. The pivotal movement of the squeegee 29 and flood bar 30 is reversed at the opposite end of screen 25 as pneumatic cylinder 39 pivots the squeegee 29 downwardly and flood bar 30 upwardly, in preparation for the print stroke.

Attached to the outer edge of carriage 27 (see FIG. 1) is a downwardly extending support 23 having elongated slots 28 to which a pneumatic cylinder 37 is adjustably mounted. Cylinder 37 includes a piston 33 having a nose cone 40 fixed to its outwardly extending end which is insertable within the neck 32 of a bottle 31 to be printed (see FIG. 1). Cylinder 37 is actuated by air lines 70 and 71 to alternately move nose cone 40 into neck 32 of bottle 31 and withdraw nose cone 40 in timed sequence with the printing operation, as discussed below. Cylinder 37 may be moved upwardly or downwardly along slots 28 of support 23 to position nose cone 40 in alignment with the neck 32 of bottles 31 having various diameters.

Figure 4:
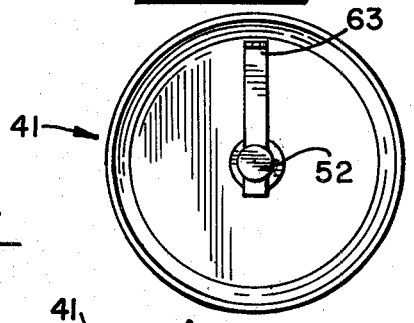
FIG. 4 is an end view of the bottle support showing the registration pin of the subject printing press.
Figure 3:
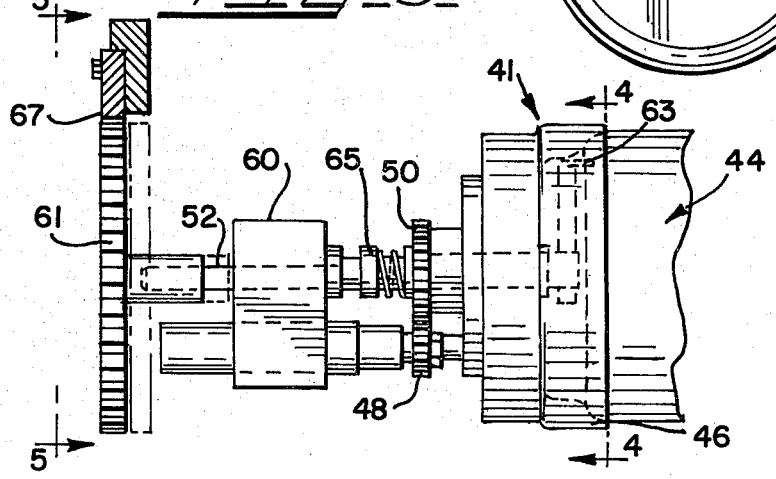
FIG. 3 is an enlarged cross-sectional view of the bottle support and rotation means.
Figures 2, 5:
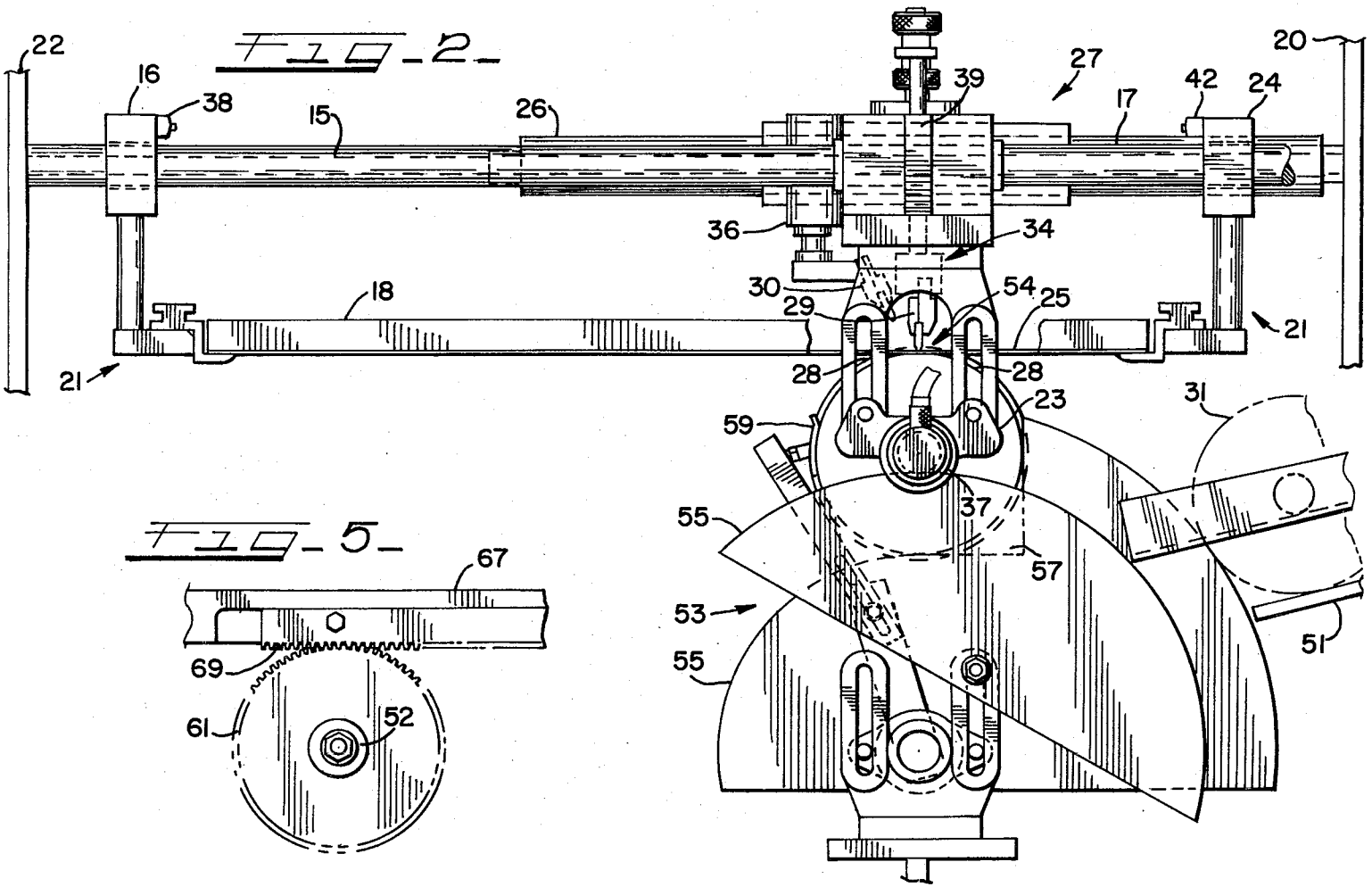
FIG. 2 is a partial cross-sectional view of the subject printing press taken generally long line 2—2 of FIG. 1 showing the bottle delivery means and carriage guide means.
FIG. 5 is a partial end view taken generally along line 5—5 of FIG. 3, showing the bottle rotation means.

Referring now to FIGS. 2–4, the bottles 31 to be printed are fed down a chute 51 to a bottle transfer mechanism 53 which includes a pair of generally semicircular plates 55 spaced apart at an interval corresponding to the width of the chute 51. Plates 55 are formed with cut-outs 57 to provide a surface in the shape of a right angle to support bottle 31 while it is transferred adjacent nose cone 40 in preparation for the print cycle. An adjustable holding plate 59 is mounted on transfer mechanism 53 rearwardly of the cut-outs 57 in plates 55 to hold bottle 31 in place thereagainst as it is rotated to the printing station, labeled with the reference 54. Once a bottle 31 is rotated to the printing station 54, transfer mechanism 53 is rotated in the opposite direction by a pneumatic cylinder (not shown) to position cut-outs 57 adjacent chute 51 to receive the next bottle 31 to be printed.

At the printing station 54, bottle 31 is positioned in alignment with squeegee 29, and rotated so that the same point on the circumference of each bottle 31 is registered beneath squeegee 29 in preparation for printing. The means for alignment and registration of bottle 31 is shown in FIGS. 1, 3 and 4.

As bottle 31 is advanced to the printing station 54 by transfer mechanism 53, cylinder 37 is actuated by air line 70 to move nose cone 40 into the bottle neck 32 and seal the bottle 31 fluid-tight. Nose cone 40 urges bottle 31 against the guide ring 46 of a bottle support or chuck 41, which receives and supports the base 44 of bottle 31. Thus, bottle 31 is held at each end immediately beneath printing screen 25 in preparation for printing. An air line 74, attached to nose cone 40, provides a stream of air into bottle 31 at an constant pressure to avoid buckling or deflection of the walls of the bottle 31 during printing.

Bottle support 41 is rotated in advance of receiving bottle 31 by an upper gear 50 attached thereto, which meshes with a lower gear 48. Lower gear 48 is continuously rotated by a pneumatically-operated motor 60, which is adjustably mounted to a support shaft 58 attached to carriage 27.

A drive shaft 52, attaching at one end to a central opening in bottle support 41 and at the other end to gear wheel 61, is supported by a bearing (not shown) in the housing of motor 60. Motor 60 may be moved upwardly and downwardly along shaft 58 to position bottle support 41 in alignment with nose cone 40 each time a different diameter bottle 31 is printed by press 11. A registration pin 63 is mounted to drive shaft 52 within bottle support 41, both of which remain stationary as bottle support 41 rotates in advance of receiving bottle 31. Bottle 31, which may be made of plastic or an equivilent, is formed with an indentation on its base to assist in registering each bottle 31 in the same position for printing, as discussed below.

When bottle 31 is forced against bottle support 41 by nose cone 40, bottle support 41 engages bottle 31 and rotates it therewith. Such rotation continues until the indentation of bottle 31 engages registration pin 63. As shown in FIG. 3, a clutch 65 is mounted on shaft 52, which is actuated by the slight rotational movement of shaft 52 caused by the engagement of registration pin 63 with the indentation in bottle 31. Clutch 65 is operable to engage bottle support 41 with shaft 52 for unitary movement. Gear wheel 61 is rotatable with shaft 52 and movable along an adjustable arm 67 having a toothed section 69 formed to mesh with gear wheel 61.

Therefore, the printing operation of the embodiment of the press 11, shown in FIGS. 1 and 2, may be summarized as follows. Once delivered to printing station 54, nose cone 40 engages the neck 32 of bottle 31 and cylinder 37 is actuated to seat bottle 31 within the guide ring 46 of rotating bottle support 41. Bottle support 41 rotates bottle 31 until the indentation on its bottom surface engages registration pin 63. In response to the contact of bottle 31 with pin 63, clutch 65 engages shaft 52 so that the bottle support 41 and shaft 52 are rotatable in unison. At this stage of the press operation, the bottle 31 to be printed is aligned directly beneath squeegee 29 and is registered so that the print design will begin at the same point on the circumference of each bottle 31.

In timed sequence with the alignment and registration of bottle 31, carriage 27 engages limit switch 42 to begin its movement to the other end of screen 25. Simultaneously, cylinder 39 is actuated to pivot squeegee 29 into contact with screen 25 which engages the surface of bottle 31 directly beneath. As carriage 27 moves toward the opposite end of press 11, gear wheel 61 moves therewith along toothed section 69 of adjustable arm 67. Since bottle support 41 is directly engaged with shaft 52 by clutch 65, bottle 31 rotates with gear wheel 61 and bottle support 41 along the length of screen 25 in unison with the movement of carriage 27 and squeegee 29 to print the bottle 31. The speed of rotation of bottle 31 is controlled by the diameter of gear wheel 61, which corresponds to the bottle diameter. At the end of the printing stroke, as carriage 27 engages limit switch 38, the now-printed bottle 31 is released from nose cone 40 and bottle support 41, and placed on a conveyor (not shown) for transport to an ink dryer.

Referring now to FIGS. 6–10, an alternate embodiment of the subject invention is shown which includes a mechanical drive means and vacuum-operated transfer mechanism.

Figure 6:
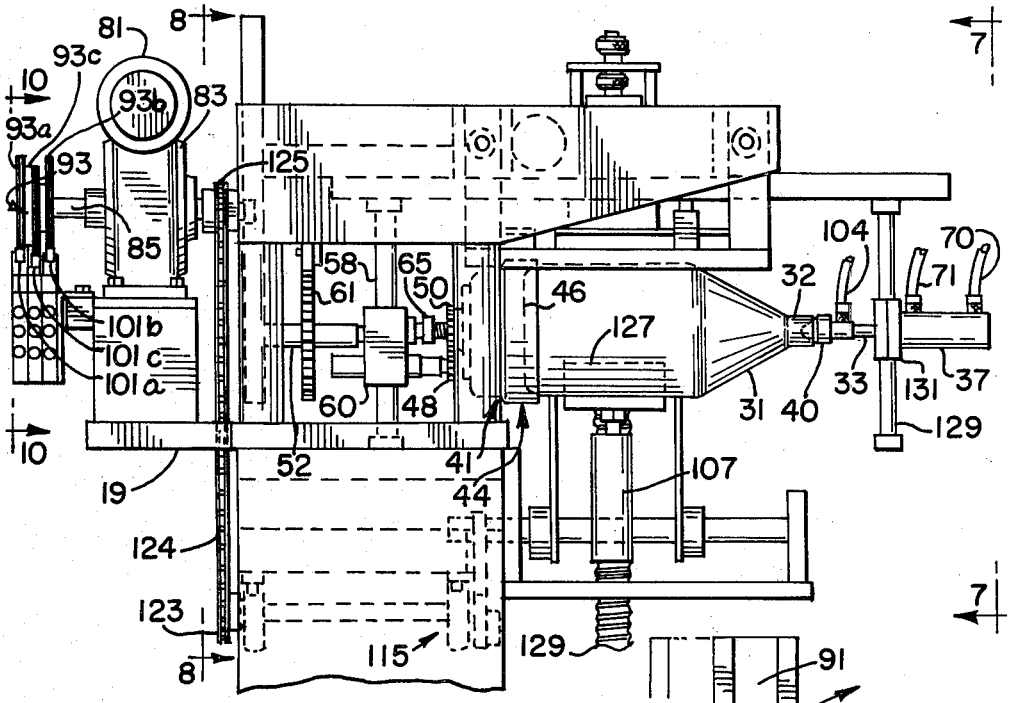
FIG. 6 is a partial front perspective view of an alternate embodiment of the present invention showing the drive means for the carriage support and bottle transfer means.
Figure 8:
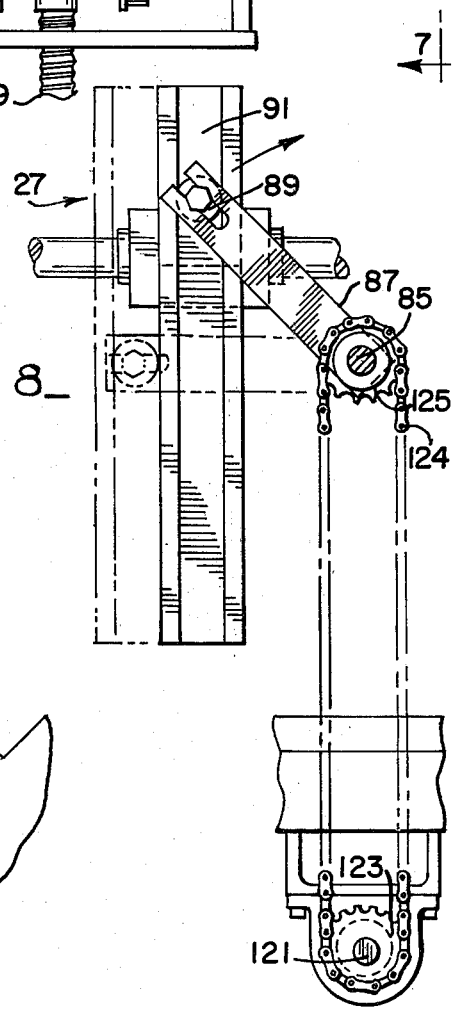
FIG. 8 is a partial cross-sectional view taken generally along line 8—8 of FIG. 6 showing the mechanical drive system of the alternate embodiment of the press herein.
Figures 7, 10:
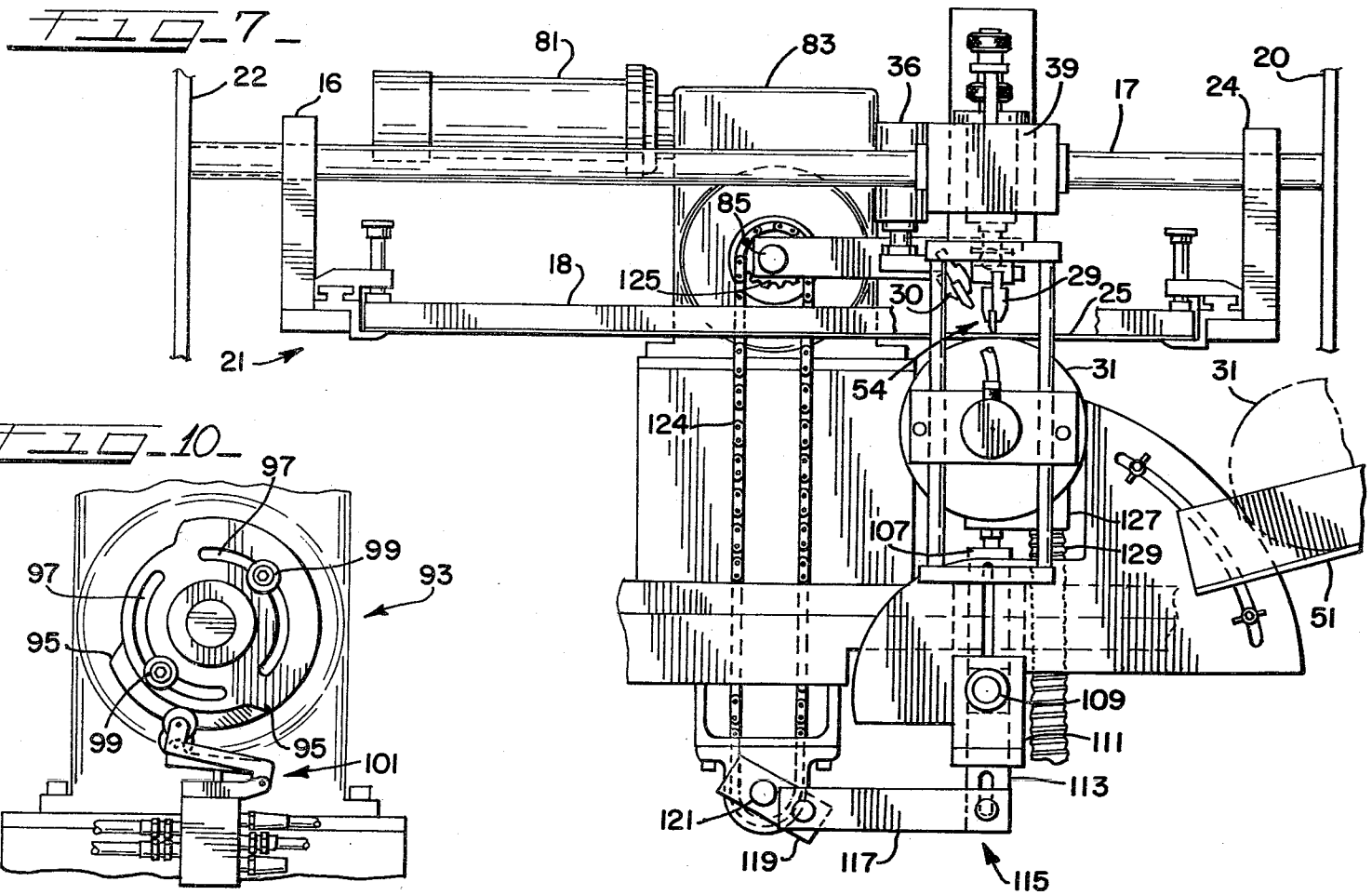
FIG. 7 is a partial cross-sectional view of the embodiment shown in FIG. 6, taken generally along line 7—7 of FIG. 6, showing the vacuum transfer means of this embodiment.

A mechanical drive system may be substituted for pneumatic drive cylinder 26 and the limit switches 38 and 42 which control its movement as discussed above. As shown in FIGS. 6–8, press 11 includes a motor 81 ganged to a gear reducer 83 having an output shaft 85. Attached at one end of shaft 85 and rotatable therewith is a crank arm 87 having a roller 89 attached to its free end. Roller 89 is movable within an elongated channel or track 91 which attaches to carriage 27. Thus, as crank arm 87 rotates with shaft 85, carriage 27 is reciprocated back and forth along printing screen 25 in response to the movement of roller 89 within track 91.

Referring now to FIGS. 6 and 8, the other end of output shaft 85 of gear reducer 83 is shown, having a series of actuator cams labeled generally with the reference 93, adjustably attached thereto. Each of the cams 93 is formed with at least one raised trip surface 95 on their circumference, and include a pair of elongated slots 97 through which adjustment bolts 99 are inserted. Immediately beneath and in alignment with each one of the cams 93 are pneumatic switches labeled generally with the reference 101 having air lines 103 connecting to various cylinders on press 11 as discussed below. Switches 101 are positioned to be actuated as the trip surface 95 of the respective cam 93 directly above rotates into contact therewith.

In the course of a printing cycle of press 11, the mechanical drive means and cam arrangement described above cooperate as follows.

At the beginning of the print stroke, cam **93*a* depresses switch 101*a* to activate cylinder 37 which causes nose cone 40 to enter the bottle neck 32 and seat the base 44 of bottle 31 against the guide ring 46 of bottle support 41 in preparation for printing, as discussed above. Cam 93*b* then contacts the corresponding switch 101*b* to activate cylinder $\beta$ which pivots squeegee 29 into position on printing screen 25 for the print stroke. Crank arm 87, continuing its rotational movement with shaft 85, drives carriage 27 to the opposite end of screen 25, thus completing the print stroke. At the end of the print stroke, nose cone 40 is withdrawn from the neck 32 of bottle 31, releasing it on a conveyor means (not shown) for transfer to an suitable dryer such as an ultraviolet dryer for curing. Simultaneously, cam 93*c* contacts switch 101*c* to activate cylinder 36 which pivots the flood bar 30 into contact with printing screen 25 for the flood stroke as carriage 27 is moved in the opposite direction by crank arm 87**.

Cams 93 are readily adjustable by loosening bolts 99 and rotating them along shaft 85 to vary the point at which trip surfaces 95 contact switches 101. For bottles 31 of a larger diameter, or smaller diameter bottles with print extending around a substantial portion of the bottle circumference, cams 103 may be adjusted to maintain squeegee 29 in contact with printing screen 25 for a longer period to assure printing of the entire design. Adjustments to shorten the print stroke are also easily made by rotating cams 93 to place trip surfaces 95 into contact with switches 101 earlier in the print stroke (see FIG. 10).

Figure 9:
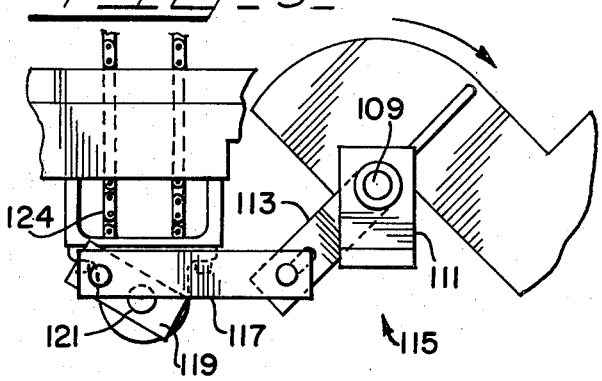
FIG. 9 is a partial perspective view of the vacuum transfer means crank assembly; and, FIG. 10 is an end view taken generally along line 10—10 of FIG. 6 showing the cam and switch control means of the mechanical drive system of the alternate embodiment of the press herein.

Referring now to FIGS. 7 and 9, an alternate means of transferring bottle 31 into position adjacent nose cone 40 at the printing station 54 is shown. A vacuum transfer assembly is provided having a pivot arm 107. fixed to a shaft 109, which is rotatably mounted to a bracket 111 at one end and fixed to an arm 113 at the other end. Pivot arm 107 is part of a crank assembly, labeled generally with the reference 115 (see FIG. 9), which includes a bar 117 pinned at one end to arm 113 and at the other end to rotating bar 119. Rotating bar 119 is fixed to one end of a rod 121 which attaches at the other end to sprocket 123. Upwardly and in alignment with sprocket 123 is a drive sprocket 125 attached to the output shaft 85 of gear reducer 83 (see FIG. 8). Sprockets 123 and 125 are connected for unitary movement by a link chain 124.

Pivot arm 107 includes a cradle 127 mounted at its free end which is formed to receive bottle 31. A vacuum line 129 connects to an orifice in cradle 127 (not shown) and is operable to hold a bottle 31 within cradle 127 for transfer to printing station 54. Such transfer is accomplished as pivot arm 107 is reciprocated from a position adjacent chute 51 to the printing station 54 and then back to chute 51, as shaft 109 rotates in response to the operation of crank assembly 115 driven by rod 121. Bottle 31 is thus aligned with nose cone 40 and seated against bottle support 41 in preparation for printing. As shown in FIG. 6, cylinder 37 is mounted in a block 131, which is movable along a pair of rods 129 attached to carriage 27. Block 131 may be adjusted to align nose cone 40 with the neck 32 of bottles 31 of various diameters in preparation for printing.

As discussed above, bottle 31 is rotated with guide ring 46 until the depression in the base 44 of bottle 31 engages pin 63. To assure proper registration of bottle 31 with pin 63, crank assembly 115 includes a brake (not shown) which momentarily delays movement of pivot arm 107 in a direction toward chute 51. This enables bottle 31 to fully seat in proper registration before the vacuum at cradle 127 is released to begin the print cycle.

It can be appreciated that by mounting both the squeegee 29 and bottle support 41 to carriage 27, unitary movement of the squeegee 29 and bottle 31 is assured, providing uniform print location and definition. In addition to the advantage of accurate and dependable print registration on each bottle, the subject press requires only one-half of the press bed length of conventional movable screen presses. As is apparent, presses utilizing a movable screen must have a press bed length equivilent to twice the length of the screen to complete the print stroke. Since the present invention includes a carriage for moving both the squeegee and bottle in unison, the press bed length may be limited to only the length of the fixed screen, which corresponds to the bottle diameter.

While the invention has been described with reference to a preferred embodiment, it will be understood by those skilled in the art that various changes may be made and equivilents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out the invention, but that the invention will include all embodiments falling within the scope of the appended claims.

We claim:

1. A printing press for applying ink to generally cylindrical-shaped bottles comprising:

a frame;

a carriage mounted for reciprocal movement along said frame;

screen support means fixed to said frame with a printing press screen mounted therein;

bottle support means mounted to said carriage beneath said printing screen, said bottle support means being formed to receive the base of said bottle, said bottle support means being movable with said carriage along the length of said printing screen;

bottle feeding means including a bottle supply located below and offset from said bottle support means, transfer means including arm means pivoted about a fixed axis below said bottle support means and movable along an arcuate path to move bottles from said supply into alignment with said bottle support means;

registration means associated with said bottle support means and engageable with the base of said bottles, said registration means including a rotatable shaft having one end connected to said bottle support means with a gear wheel connected to an opposite end, said gear wheel being movable along the length of said screen, a motor supported on said shaft and having an output shaft connected to said bottle support means to rotate said bottle support means independent of said shaft, clutch means interposed between said bottle support means and said shaft, said clutch means being operable to interconnect said shaft and said bottle support means as said registration means engages the base of said bottle, whereby as said bottle contacts said bottle support means and engages said registration means, said clutch means operates to interconnect said shaft and said gear wheel with said bottle support means for unitary movement along the length of said screen;

nose cone means mounted to said carriage in alignment with said bottle support means, means for moving said nose cone means into the neck of said bottle to grip said bottle between said nose cone means and said bottle support means, said nose cone means being movable with said carriage in unison with said bottle support means and cooperating therewith to support said bottle for rotational movement along the length of said printing screen; and a printing assembly mounted to said carriage above said printing screen and being movable therewith, said printing assembly including a squeegee and flood bar, said squeegee being operable to contact said printing screen to force ink therethrough for printing said bottle, whereby said printing assembly, said bottle support means and said nose cone means cooperate to print said bottle while moving in unison with said carriage along the length of said printing screen.

2. The printing press of claim 1 in which said arm means includes a pair of spaced plates pivoted on said fixed axis and having cutouts to define a cradle for receiving and supporting said bottles during transfer.

3. The printing press of claim 1 in which said arm means includes a single arm pivoted about said fixed axis, said arm having a cradle at an outer end for receiving bottles and vacuum means connected to said cradle for retaining said bottle thereon during transfer.

4. The printing press of claim 1 further including pneumatic drive means between said frame and said carriage for reciprocating said carriage.

5. The printing press of claim 1, further including guide rods on said frame for supporting said carriage, drive means on said frame including an output shaft having an arm received thereto with a roller supported on a free end of said arm, and a track on said carriage receiving said roller so that rotation of said output shaft will reciprocate said carriage on said guide rods.

6. A printing press for applying ink to generally cylindrical-shaped bottles comprising:

a frame;

a guide member fixed to said frame;

a carriage suspended for reciprocal movement along said guide member;

drive means for reciprocating said carriage along said guide member;

screen support means having a printing screen mounted therein and supported in a fixed position on said guide member;

bottle support means mounted on a lower end of said carriage beneath said printing screen, said bottle support means being formed to receive the base of said bottle, said bottle support means being movable with said carriage along the length of said printing screen;

nose cone means mounted to said carriage in alignment with said bottle support means with an open space between and below said nose cone means and said bottle support means, said nose cone means being insertable within the neck of said bottle to suspend said bottle below said printing screen for movement along the length of said printing screen, said nose cone means being movable with said carriage in unison with said bottle support means to move said bottle along said screen;

a drive member fixed to said frame, and a driven member on said bottle support means engaging said drive member to rotate said bottle;

adjustment means between said carriage, said bottle support means and said nose cone means to accommodate bottles of different sizes;

bottle feeding means for feeding bottles into said space to be gripped between said bottle support means and said nose cone means; and, a printing assembly mounted to said carriage above said printing screen and being movable therewith, said printing assembly including a squeegee and flood bar, said squeegee being operable to contact said printing screen to force ink therethrough for printing said bottle, whereby said printing assembly, said bottle support means and said nose cone means cooperate to print said bottle while moving in unison with said carriage along the length of said printing screen.

7. The printing press of claim 6 wherein said drive means comprises a motor having an output shaft, a crank arm rotatable with said output shaft and having a roller mounted on its free end, a track mounted to said carriage receiving said roller so that rotation of said shaft will reciprocate said carriage along said frame; a cam assembly including a plurality of cams rotatable with said output shaft, and a switch assembly including a plurality of switches corresponding to said cams and being mounted in alignment therewith, said cams being positioned to selectively contact said switches for actuating said nose cone means and said squeegee to print said bottle.

8. The printing press of claim 6 including an elongated chute for supporting said bottle to be printed, and a vacuum transfer means having a crank assembly, said crank assembly including a transfer arm having a cradle means mounted at one end, said cradle means being formed to support said bottle and connecting to a vacuum line for holding said bottle thereagainst, said transfer arm being reciprocated by said crank assembly from a position adjacent said chute to a position between said nose cone means and bottle support means to move said bottle immediately beneath said squeegee and said printing screen in preparation for printing.

* * * * *